US010583669B1

(12) United States Patent
Pirmoradi et al.

(10) Patent No.: US 10,583,669 B1
(45) Date of Patent: Mar. 10, 2020

(54) METHOD AND SYSTEM FOR PRODUCING STABLE LOCKED COLORS IN THERMOCHROMIC MATERIALS

(71) Applicant: Palo Alto Research Center Incorporated, Palo Alto, CA (US)

(72) Inventors: Fatemeh Nazly Pirmoradi, Menlo Park, CA (US); Christopher L. Chua, San Jose, CA (US); Yu Wang, Union City, CA (US); Alex Hegyi, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/211,810

(22) Filed: Dec. 6, 2018

(51) Int. Cl.

| | |
|---|---|
| ***B41J 2/475*** | (2006.01) |
| ***B41M 5/34*** | (2006.01) |
| ***B41M 5/28*** | (2006.01) |
| ***B41J 2/44*** | (2006.01) |

(52) U.S. Cl.
CPC ..... *B41J 2/475* (2013.01); *B41J 2/442* (2013.01); *B41M 5/282* (2013.01); *B41M 5/34* (2013.01)

(58) Field of Classification Search
CPC ..... B41J 2/475; B41J 2/442; B41M 5/282; B41M 5/34
See application file for complete search history.

(56) References Cited

U.S. PATENT DOCUMENTS

| | | | | |
|---|---|---|---|---|
| 8,842,145 | B2 | 9/2014 | Cridland et al. | |
| 9,475,307 | B2 | 10/2016 | Cridland | |
| 9,616,699 | B2 * | 4/2017 | Garnier | B41M 3/14 |
| 10,353,287 | B1 * | 7/2019 | Jiang | G03F 7/2014 |
| 2008/0318154 | A1 | 12/2008 | Wyres | |
| 2017/0028763 | A1 * | 2/2017 | Arsenault | G02F 1/0147 |

* cited by examiner

*Primary Examiner* — Lamson D Nguyen
(74) *Attorney, Agent, or Firm* — Mueting, Raasch & Gebhardt, P.A.

(57) ABSTRACT

A method of forming a multi-colored image on a substrate that includes a thermochromic material capable of producing at least two different colors is disclosed. The method includes heating individually selected pixels of the thermochromic material that correspond to the image to one or more first temperatures sufficient to activate the selected pixels of the thermochromic material for color shift. The area corresponding to the individually selected pixels is flooded with a first UV radiation dosage sufficient to at least partially polymerize the thermochromic material. The individually selected pixels are heated to one or more second temperatures while the area is flooded with a second UV radiation dosage.

22 Claims, 15 Drawing Sheets

METHOD AND SYSTEM FOR PRODUCING STABLE LOCKED COLORS IN THERMOCHROMIC MATERIALS

BACKGROUND

Thermochromic materials change color in response to exposure to temperature and light. Thermochromic inks can be applied to relatively larger areas on a substrate by a number of printing or coating processes such as lithography, flexography, gravure, screen printing, spreading with film applicators. After coating or printing the larger areas with the thermochromic material, the areas are exposed to heat and light to produce a color change in precisely controlled regions.

BRIEF SUMMARY

Some embodiments involve a method of forming a multi-colored image on a substrate that includes a thermochromic material capable of producing at least two different colors. The method includes heating individually selected pixels of the thermochromic material that correspond to the image to one or more first temperatures sufficient to activate the selected pixels of the thermochromic material for color shift. The area corresponding to the individually selected pixels is flooded with a first UV radiation dosage sufficient to at least partially polymerize the thermochromic material. The individually selected pixels are heated to one or more second temperatures while the area is flooded with a second UV radiation dosage.

Some embodiments are directed to an apparatus for forming a multi-colored image on a substrate that includes a thermochromic material capable of producing at least two different colors. A first heat source provides heat producing energy that heats individually selected pixels of the thermochromic material to one or more first temperatures sufficient to activate the individually selected pixels for color shift. A first UV source floods an area corresponding to the individually selected pixels with a first UV radiation dosage sufficient to partially polymerize the thermochromic material. A second heat source provides heat producing energy that heats the individually selected pixels of the thermochromic material to one or more second temperatures after the individually selected pixels have been flooded with the first UV radiation dosage. A second UV radiation source floods the area corresponding to the individually selected pixels with a second UV radiation dosage during a time that second heat source heats the individually selected pixels to the second temperatures.

Some embodiments are directed to an article comprising a substrate and a thermochromic material disposed in or on the substrate. A color of the thermochromic material exhibits a color change of less than $\Delta E_{76}=3$ when exposed to a Level 2 environment as measured by the Blue Wool Scale Fading Card for 35 days.

BRIEF DESCRIPTION OF DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

The approaches disclosed herein involve a system and method for image formation that provides stable, locked colors in thermochromic material capable of producing at least two different colors. Image formation as discussed herein involves the use of a thermochromic material that changes color and forms a stable, color-locked multi-colored image in thermochromic material when exposed to heat and light.

The disclosed embodiments involve a color shifting and stabilization step during which individually selected pixels of the thermochromic material are flooded with ultraviolet (UV) radiation while being simultaneously heated. Colors created through this process are stable and hold their originally produced colors even under intense short wavelength UV illumination.

Figure 1:
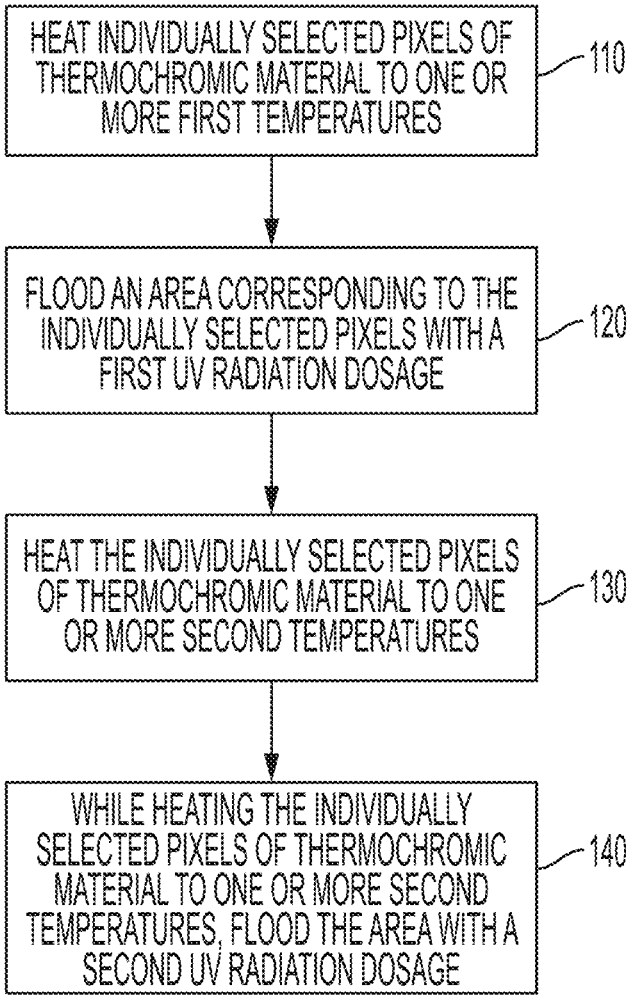
FIG. 1 is a flow diagram of a method of forming a multi-colored image on a substrate that includes a thermochromic material capable of producing at least two different colors in accordance with some embodiments.

FIG. 1 is a flow diagram illustrating a method of forming a multi-color image having stable, locked colors in accordance with embodiments discussed herein. The process involves initially heating 110 individually selected pixels of a thermochromic material that correspond to the image to one or more first temperatures. The one or more first temperatures are selected to activate the pixels for color shift.

To produce an image that includes multiple levels of color saturation, the pixels are heated to multiple different first temperatures. Individually selected pixels can be heated to multiple different first temperatures, which correspond to different degrees of activation. The different degrees of activation lead to different darkness (saturation) levels in the final colors formed. For example, pixels not heated or heated below a threshold activation temperature would remain unchanged after the entire color processing sequence. Pixels heated to temperatures slightly above the threshold activation temperature in the first heating step would achieve a lighter saturation level after the complete color processing sequence. Pixels heated to temperatures above a full activation temperature in the first heating step would attain a darker color saturation level after the complete color processing sequence. In some embodiments, the threshold activation temperature is about 80° C. and the full activation temperature is about 110° C. The threshold activation temperature and the full activation temperature can be adjusted depending on the constituent molecules and coating thickness used in the thermochromic material.

After or during the initial heating step, the area that includes the individually selected pixels is flooded 120 with a first UV radiation dosage that partially polymerizes the thermochromic material of the pixels causes a first color shift of the pixels. Heating the pixels to the first temperatures is performed without exposure to a significant UV radiation and the first UV radiation dosage is applied without substantially heating the pixels.

After the first UV radiation dosage is applied, the individually selected pixels are heated 130 a second time to one or more second temperatures. To produce a multi-colored image, the pixels are heated to multiple different second temperatures. In some implementations, each of the second temperatures is about 30% higher than any of the first temperatures. Each second temperature corresponds to a predetermined second color shift of the thermochromic material. While the individually selected pixels are being heated during the second heating step, the area that includes the individually selected pixels is flooded 140 with a second UV radiation dosage that causes a change in the shape of the polymerized molecules leading to a shift in the optical absorption spectrum of the coating, and to a color shift in the appearance of the thermochromic material.

Thermochromic articles that have been concurrently exposed to UV radiation and heating to the second temperatures have been shown to have superior color stability when compared to the color stability of thermochromic articles that have been heated to the second temperatures but not concurrently exposed to UV radiation.

In some embodiments, the initial heating 110 is performed simultaneously with the first UV flood 120. In these embodiments, steps 110 and 120 are combined, and the activation step is performed in the presence of UV radiation, where activation and polymerization are performed together, rather than in sequence.

FIG. 2A through 2G illustrate a system 200 for forming an image in pixels 221, 222, 223 of a thermochromic material 220 disposed on a substrate 210 in accordance with some embodiments described herein. The components 230-2, 230-2, 240-2, 240-2, 250, 260-2, 270-2, 265 of the system 200, the substrate 210, and the thermochromic layer 220 are shown in side views in FIGS. 2A through 2G.

As illustrated in FIGS. 2A through 2G, a layer 220 comprising a thermochromic material is applied to a region of the substrate 210 in which the image will be formed. The layer 220 is shown extending along the x-axis in the side view of FIGS. 2A through 2H, however, it will be appreciated that the layer 220 also extends along the y-axis. The thermochromic layer 220 may be substantially continuous or discontinuous and may be patterned into segments of the thermochromic material.

The layer 220 may be deposited on the substrate 210 by any suitable printing process, e.g., ink jet printing, screen printing, flexographic printing, etc. The thermochromic material can be or can include diacetylene and/or or another thermochromic material capable of producing at least two colors, e.g., red and blue. In some embodiments, other additives that control and/or assist in heat absorption and/or heat retention may also be included in the layer 220. For example, in embodiments wherein the thermochromic material is heated by radiation, infrared (IR) and/or near infrared (NIR) radiation absorbers may be included in the layer to adjust the response of the thermochromic material to the radiation.

Prior to processing by heating and UV radiation exposure, the thermochromic material in layer 220 may be colorless. For example, prior to processing, the layer 220 can be substantially clear such that the substrate 210 is visible through the thermochromic material of layer 220. After processing, the thermochromic material in the unactivated pixels 223 can remain substantially clear such that the substrate 210 is visible through the pixels 223.

Each pixel of the thermochromic layer 220 is individually addressable by heat sources 230-1 and 230-2. The controller 250 maps pixels of the image to the individually selected pixels 121 of the thermochromic material and controls the heat sources 230-1, 230-2. The UV radiation sources 240-1, 240-2 are flood sources that flood an area that includes the individually selected pixels with UV radiation.

Figure 2A:
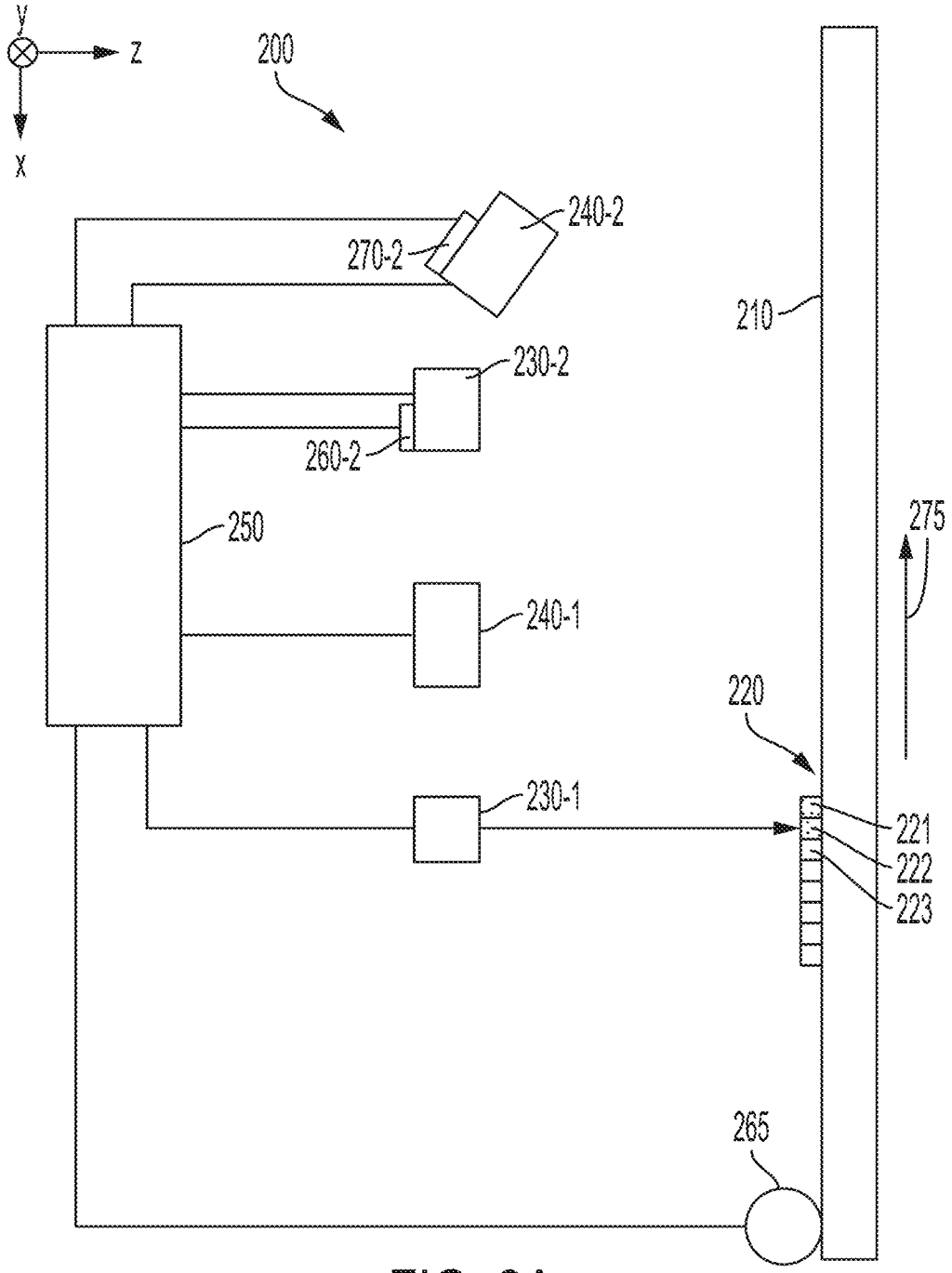
FIGS. 2A through 2G illustrate an image formation system and diagrammatically illustrate the method of FIG. 1 in accordance
Figure 2B:
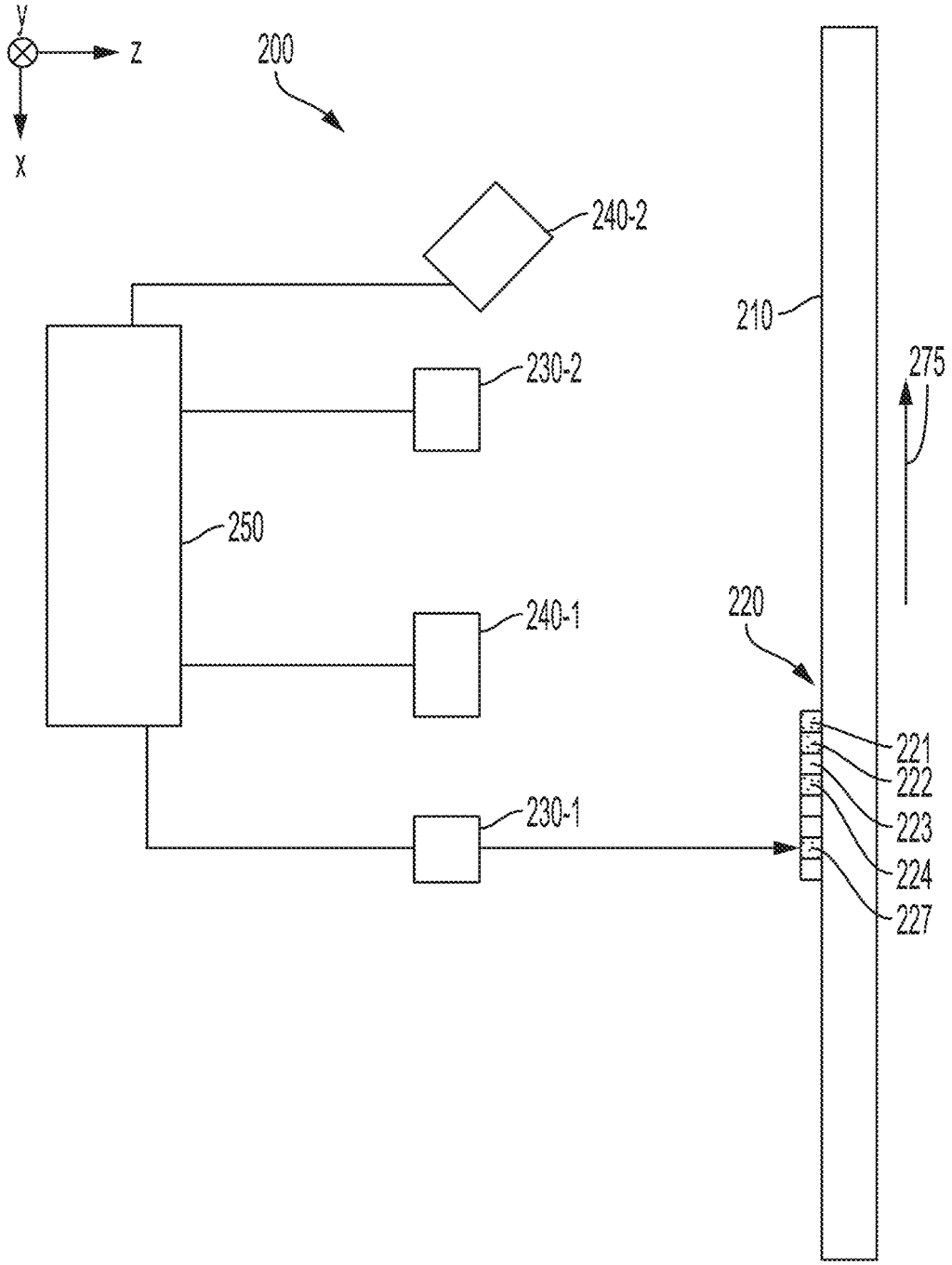

With reference to FIGS. 2A and 2B, during the first heating step, the first heat source 230-1 generates a first heat producing energy 290-1 that heats each individually selected pixel, e.g., pixels 221, 222, 227, to one or more first temperatures. For example, in some scenarios, each individually selected pixel may be heated to the same first temperature that is sufficient to activate the individually selected pixels. Alternatively, a first set of the individually selected pixels may be heated to a higher first temperature and a second set of the individually selected pixels may be heated to a lower first temperature to achieve different levels of activation. Pixels 223 are not included in the group of individually selected pixels and are not heated by the first heat source 230-1 or the second heat source 230-2. In the embodiment shown in FIGS. 2A through 2B, the heat source 230-1 simultaneously heats a line of pixels that is one pixel wide in the x direction and multiple pixels long in the y direction. Alternatively, the heat source 230-1 may simultaneously heat multiple individually selected pixels in the x direction and multiple individually selected pixels in the y direction. FIG. 2A depicts the heat source 230-1 as it is heating individually selected pixels in the line of pixels extending in the y direction that includes pixel 225. FIG. 2B depicts the heat source 230-1 as it is heating individually selected pixels in the line of pixels extending in the y direction that includes pixel 226.

Figure 2C:
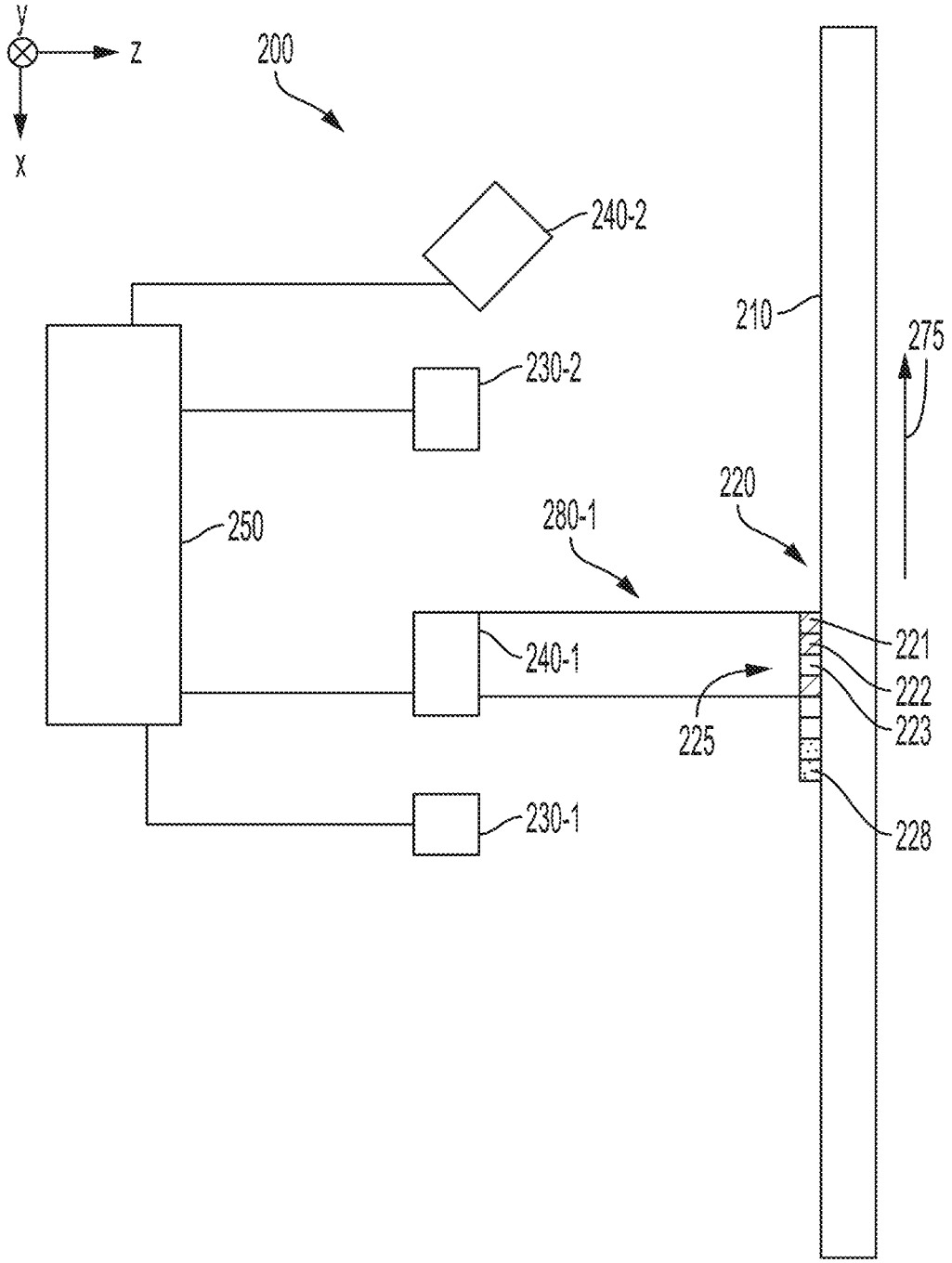
Figure 2D:
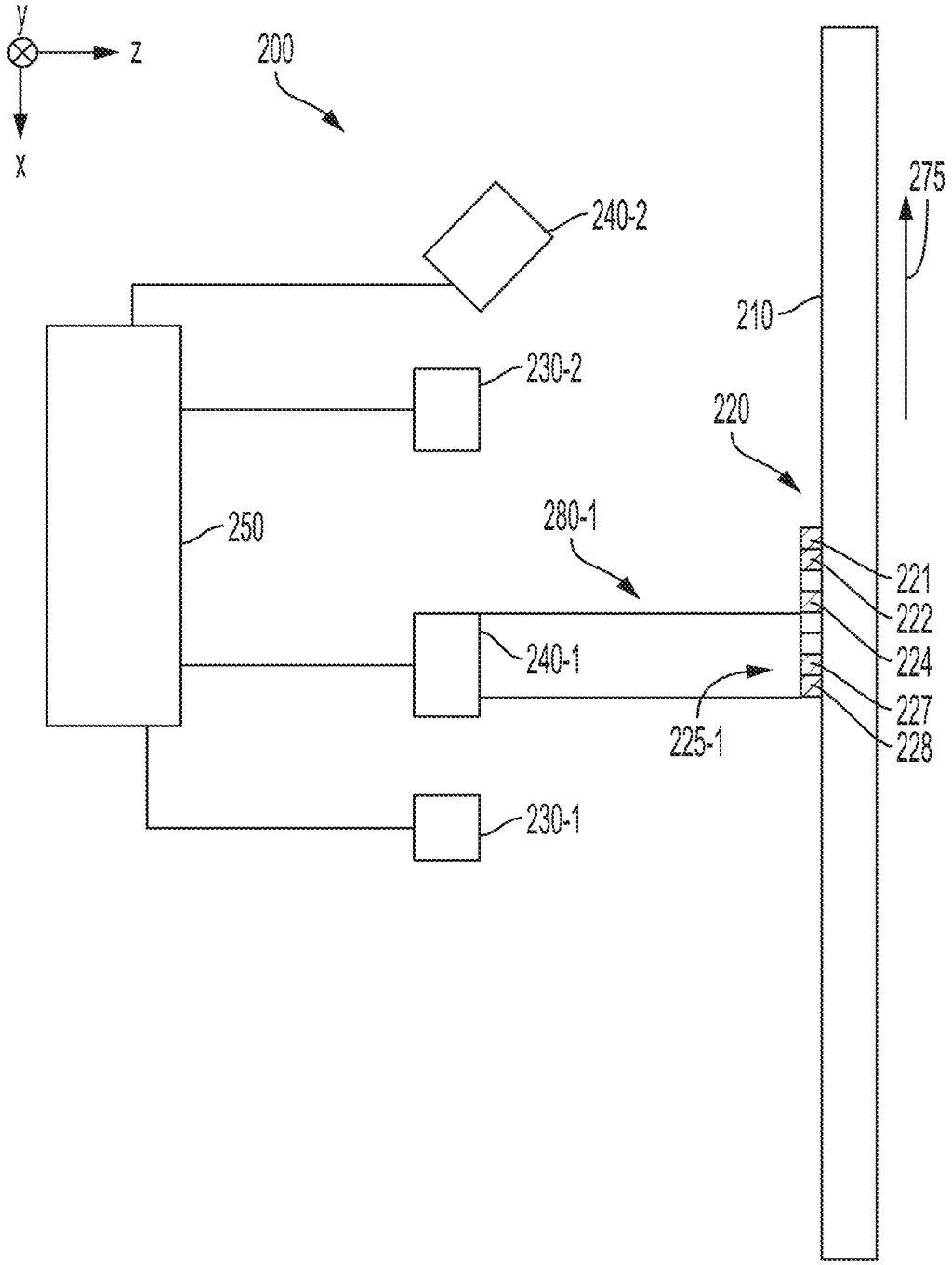

As shown in FIGS. 2C and 2D, the first UV radiation source 240-1 generates floods the pixels that have been activated with a first UV radiation dosage 280-1. The UV radiation dosage 280-1 is shown flooding the area 225-1 that includes the pixels 221-224 The first radiation dosage 280-1 causes the individually selected pixels to change color. In some embodiments, the first UV radiation dosage 280-1 is applied after the pixels have been heated to activation. Alternatively, the first UV radiation dosage 280-1 may be applied during the time that the pixels are being heated to activation. In the latter embodiment, a heat source and UV radiation source configuration as shown with reference to the heat source 230-2 and UV radiation source 240-2 may be used. Additional information about a system and method involving heating pixels during the time the pixels are flooded with UV radiation is discussed in more detail in commonly owned and concurrently filed U.S. patent application Ser. No. 16/211,749, filed Dec. 6, 2018 which is incorporated herein by reference.

Figure 2E:
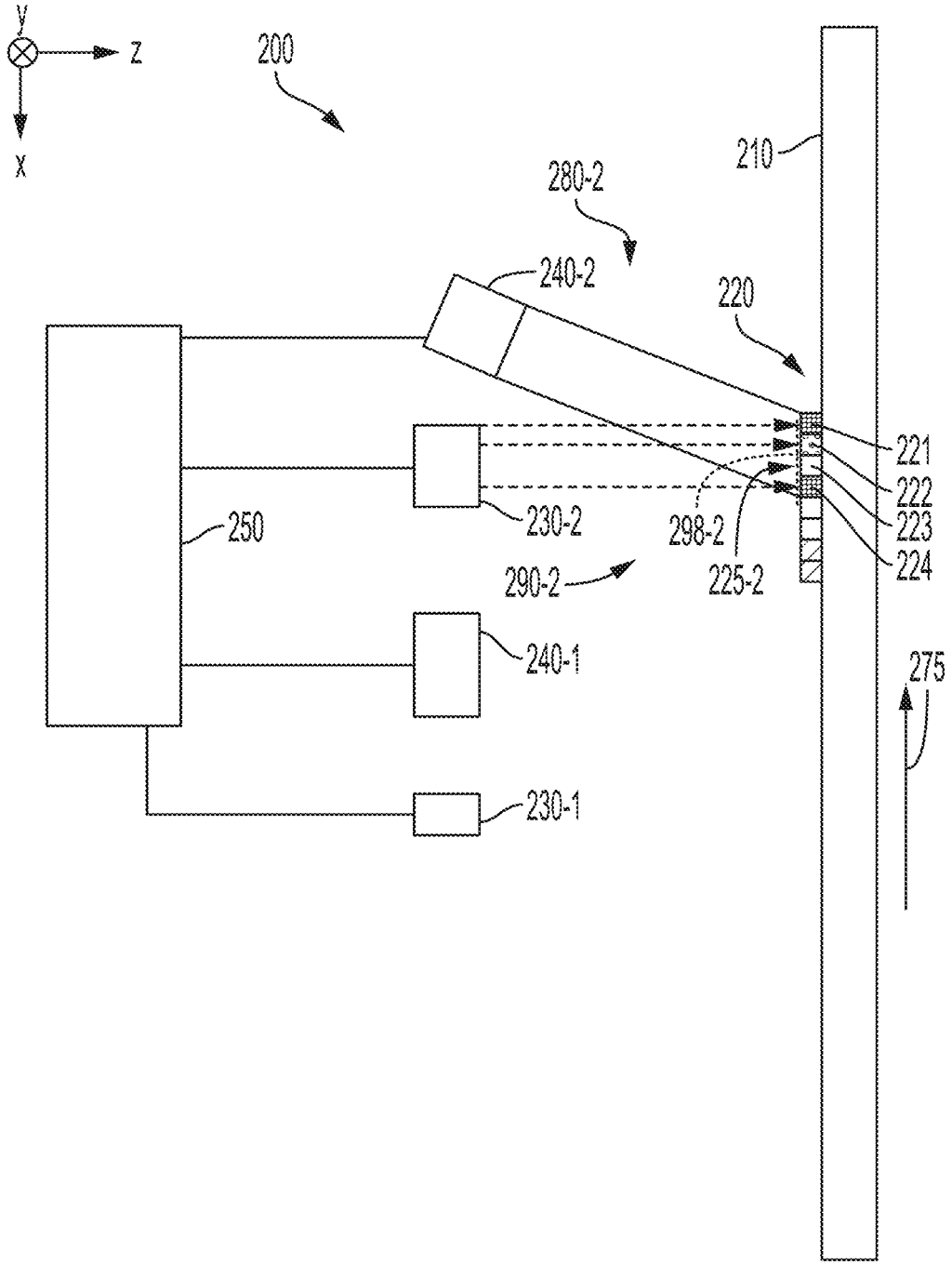
Figure 2F:
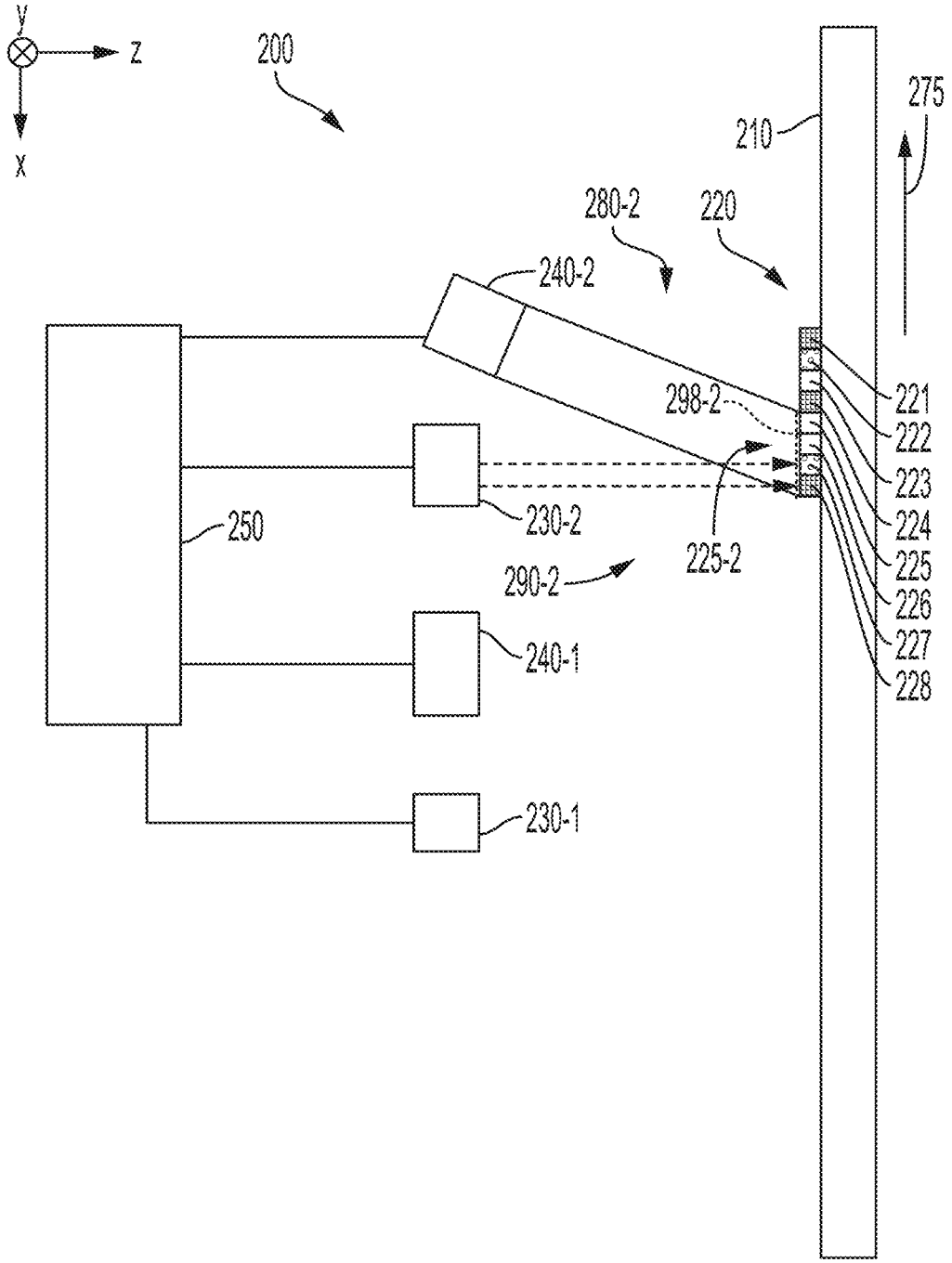

With reference to FIGS. 2E and 2F, after the area 225-1 has received the first UV radiation dosage 280-1, the controller 250 controls the second heat source 230-2 to generate a second heat producing energy 290-2 that heats each individually selected pixel to one or more second temperatures. The second temperatures correspond to a second color shift required for the pixel.

As previously discussed, during the first heating step, a first set of the individually selected pixels may be heated to a higher first temperature and a second set of the individually selected pixels may be heated to a lower first temperature, wherein the higher and lower first temperatures cause different color saturation levels. In some scenarios, a third set of the individually selected pixels 121 may be heated to a higher second temperature and a fourth set of the individually selected pixels 121 may be heated to a lower second temperature to achieve different color shifts of the third and fourth sets of pixels 121. Some or all of the first, second, third, and fourth sets of individually selected pixels 121 may include the same pixels. Some or all of the first, second, third, and fourth sets of individually selected pixels 121 may include different pixels.

During the time that the individually selected pixels are being heated to the second temperatures, the controller 250 controls the second UV radiation source 240-2 to flood the area 225-2 that includes the individually selected pixels with a second UV radiation dosage 280-2. Heating the pixels to the second temperatures while flooding the area 225-2 that includes the individually selected pixels causes the individually selected pixels to undergo a second color shift and stabilizes the color of the pixels.

In various embodiments, the second UV radiation dosage 280-2 may be 1E-6 to 1E+3 times the first UV radiation dosage 280-1. In some embodiments, the second UV radiation dosage 280-2 may be about the same as the first UV radiation dosage 280-1. For example, in some embodiments the second UV radiation dosage 280-2 may be about 400 $mJ/cm^2$ at a wavelength of about 250 nm.

One or both heat sources 230-1, 230-2 may have a resolution such that 300 pixels per inch (ppi), or 600 ppi, or even 1200 ppi at the image plane 298-1, 298-2 created by the heat source 230-1, 230-2 are individually addressable. The chosen designed resolution of the heat sources depends on tradeoffs between cost and application needs. Each UV radiation source 240-1, 240-2 is a UV radiation flood source capable of flooding an area of the thermochromic layer 220 that includes the individually selected pixels. The second UV radiation source 240-2 is capable of flooding an area 225-1, 225-2 that includes the individually selected pixels with the second UV radiation dosage 290-2 while the individually selected pixels are concurrently being heated to one or more second temperatures by heat producing energy 290-1 generated by the second heat source 230-2. For example, the flooded area 225-1, 225-2 may be 5×, 10×, 50×, or even 100× the pixel size.

According to some embodiments, control circuitry 250 may control the intensity, pattern, and movement the heat producing energy, the intensity and movement of the UV radiation, and movement of the substrate 210 to form a multi-color image in a thermochromic layer 220 disposed in or on an intermittently or continuously moving substrate 210.

The image formation system 200 shown in FIGS. 2A through 2G includes a movement mechanism comprising one or more components 260-1, 270-1, 265. (For simplicity of illustration, the movement mechanism components 260-1, 270-1, 265 are only shown in FIG. 2A and are omitted in FIGS. 2B through 2G.) Under control of the controller 250, movement mechanism component 260-2 changes the position and/or direction of the heat producing energy 290-2 generated by the heat source 230-2; movement mechanism component 270-2 changes the position and/or direction of the UV radiation dosage 280-2 generated by UV radiation source 240-2; and movement mechanism 265 changes the position of the substrate 210 relative to the heat sources 230-1, 230-2 and UV radiation sources 240-1, 240-2 so as to bring different portions of the thermochromic layer 220 into position for processing by the first heat source 230-1, the first UV radiation source 240-1, the second heat source 230-2, and the second UV radiation source 230-2.

One or both of the heat sources 230-1, 230-2 may comprise one or more heating elements. In some implementations, the position of the heat producing energy generated by one or more heating elements of the heat source 230-1, 230-2 relative to the substrate 210 can be changed by a movement mechanism component. For example, movement mechanism component 260-2 may be configured to translationally or rotationally move the heat source 230-2. In some implementations, the movement mechanism component, 260-2 is configured to change the direction of the heat producing energy, 290-2 generated by the heat source 230-2 by rotating the heat source 230-2 and/or the heating elements of the heat source, 230-2 without translationally moving the heating elements or the heat source 230-2. In other embodiments, the translational and rotational position of each heat source, 230-2 and each heating element of the heat source 230-2 is static. The direction of heat producing energy, 290-2 is controlled by the movement mechanism component, 260-2 deflecting or reflecting the heat producing energy 290-2 generated by the heat source 230-2.

One or both of the UV radiation sources 240-1, 240-2 may comprise one or more UV radiation elements. In some implementations, the position of the UV radiation generated by one or more elements of the UV radiation source 240-1, 240-2 relative to the substrate 210 can be changed by a movement mechanism component. For example, in the embodiment depicted in FIGS. 2A through 2G, movement mechanism component 270-2 can be configured to translationally and/or rotationally move the UV radiation source 240-2. In some implementations, the movement mechanism component 270-2 is configured to change the direction of the UV radiation generated by the UV radiation source 240-2 by rotating the UV radiation source, 240-2 and/or the radiation elements that make up the UV radiation source 240-2 without translationally moving the elements or the UV radiation source 240-2. In other embodiments, the translational and rotational position of the UV radiation source 240-2 and/or each element of the UV radiation source 240-2 are static. The direction of UV radiation can be controlled by the movement mechanism component 270-2 reflecting the UV radiation generated by the UV radiation source 240-2.

The control circuitry 250 and the movement mechanism comprising components 265, 260-2 can operate together to move a two dimensional image plane 298-2 of spatially patterned heat producing energy 290-2 from the second heat source 230-2 across the surface of the thermochromic material 220 on the substrate 210. Relative movement between the two dimensional image plane 298-2 and the substrate 210 can be accomplished by moving the substrate 210, translationally moving the heat producing energy 290-2, and/or rotationally changing the direction of the heat producing energy 290-2.

The control circuitry 250 and the movement mechanism comprising components 265, 270-2 can operate together to move a flood area of UV radiation from the second UV radiation sources 240-2 relative to the thermochromic material 220 on the substrate 210. The movement of the UV radiation 280-2 can be implemented such that the flood area 225-2 of UV radiation 280-2 tracks the two dimensional image plane 298-2 across the surface of the thermochromic material 220. Relative movement between the flood area 225-2 and the substrate 210 can be accomplished by moving the substrate 210, translationally moving the UV radiation 280-2, and/or rotationally changing the direction of the UV radiation 280-2.

FIGS. 2A through 2G are sequential side views of a process of image formation in according to some embodiments taken at different points in time. During this image formation process, the movement mechanism component 265 may be configured to move substrate 210 such that the substrate 210 is in intermittent or continuous motion relative to the imaging components 230-1, 230-2, 240-1, 240-2. FIG. 2A illustrates the state of the image formation at time t1. At time t1, the first heat source 230-1 has already activated individually selected pixels in a line of pixels that is one pixel wide in the x direction and extends along they direction to include multiple pixels including pixel 221. At time t1, the heat source 230-1 is directing heat producing energy 290-1 toward individually selected pixels in another line of pixels that includes pixel 222. The heat producing energy 290-1 heats the individually selected pixels to one or more first temperatures that activate the pixels. The substrate 210 is moving along the direction of arrow 275. The heat producing energy is spatially patterned along the line of pixels being activated. The spatially patterned heat producing energy 290-1 changes according to the image being produced as the substrate moves and each successive line of pixels comes into the processing area of the heat source 230-1. At time t2, the heat source 230-1 is directing patterned heat producing energy 290-1 to a line of pixels that includes pixel 227, as shown in FIG. 2B. Note that pixel 223 is not activated because pixel 223 is not in the group of individually selected pixels.

At times t3 and t4, shown in FIGS. 2C and 2D, the thermochromic material 220 has moved out of range of the first heat source 230-1. The first UV radiation source 240-1 is flooding the pixels with a first UV radiation dosage 280-1. The substrate 210 is moving along the direction of arrow 275. The first UV radiation dosage 280-1 successively exposes pixels in each line as the substrate moves. The UV radiation dosage 280-1 is controlled by the intensity of the UV radiation and the speed of the substrate movement. The UV radiation dosage 280-1 causes the activated pixels to change color.

At times t5 and t6, shown in FIGS. 2E and 2F, the heat producing energy 290-2 generated by heat source 230-2 heats the previously activated pixels to one or more second temperatures. During time t5, the heat source 230-2 produces spatially patterned heat producing energy 290-2 that simultaneously heats individually selected pixels in a group of pixels comprising multiple lines of pixels, including the lines that include pixels 221, 222, 223, and 224. During the period of time that the first group of pixels is being heated to the second temperatures, the area 225-2 that includes the first group of pixels is flooded with a second UV radiation dose 280-2 generated by UV radiation source 240-2. The substrate 210 is moving along the direction of arrow 275.

At time t6, shown in FIG. 2F, a second group of the individually selected pixels is being heated to one or more second temperatures by heat producing energy 290-2 generated by heat source 230-2. The second group of pixels includes multiple lines of pixels, including the lines that include pixels 225, 226, 227, 228. During the period of time that the second group of pixels is being heated to the second temperatures, the area 225-2 that includes the second group pixels is flooded with the second UV radiation dose 280-2 generated by UV radiation source 240-2. Heating the individually selected pixels to the second temperatures while concurrently flooding the area 225-2 that includes the individually selected pixels causes a second color shift of the pixels and stabilizes the pixel color.

Figure 2G:
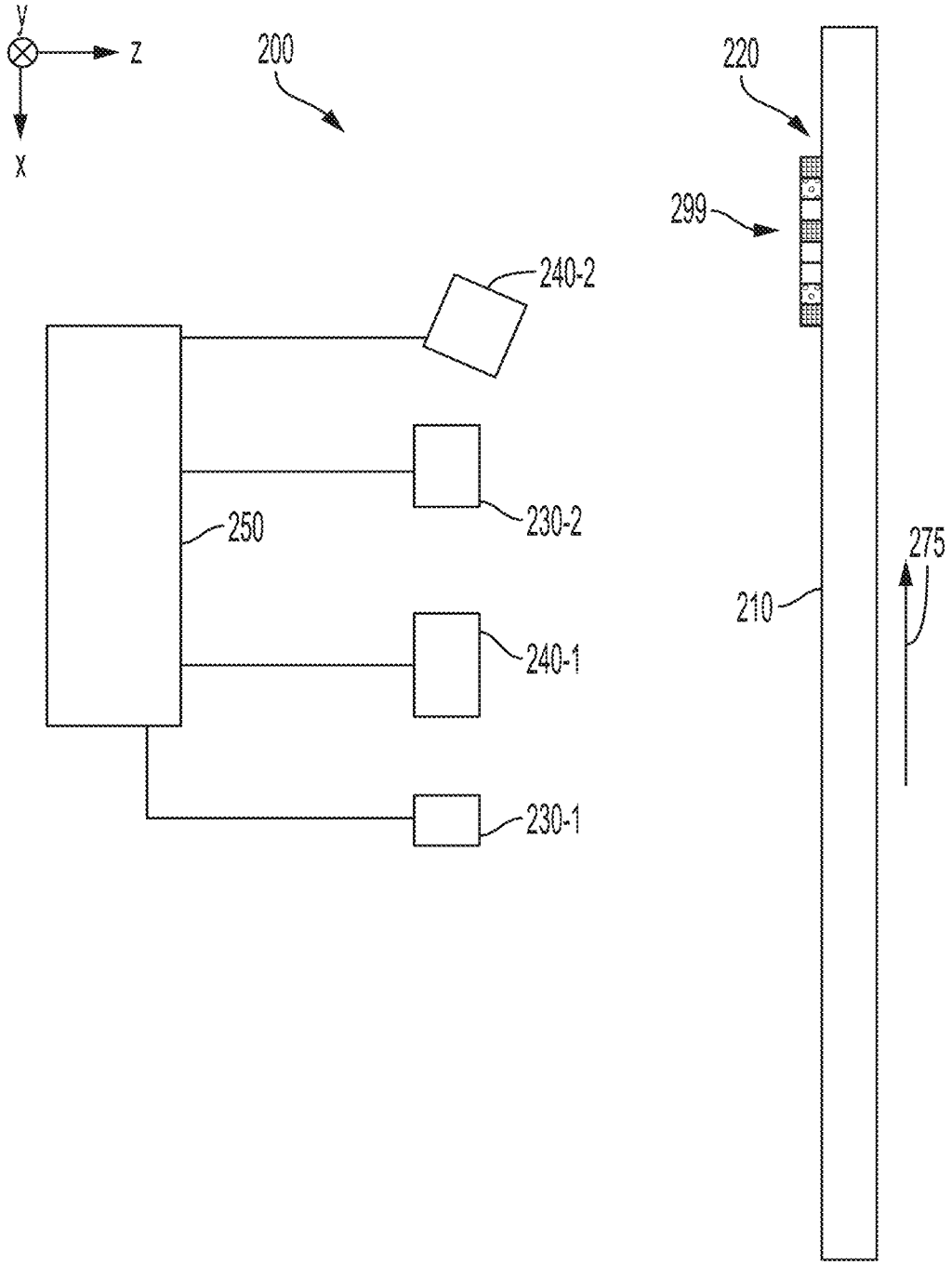

At time t7, shown in FIG. 2G, the image 299 has been formed in the thermochromic material 220, the substrate 210 is moving along the direction indicated by arrow 275, and the thermochromic material 220 has moved out of the image formation area. The pixels in image 299 have been activated, color shifted, and color stabilized at one or more colors and/or saturation levels. Pixels that were not activated or color shifted may remain colorless.

Figure 3:
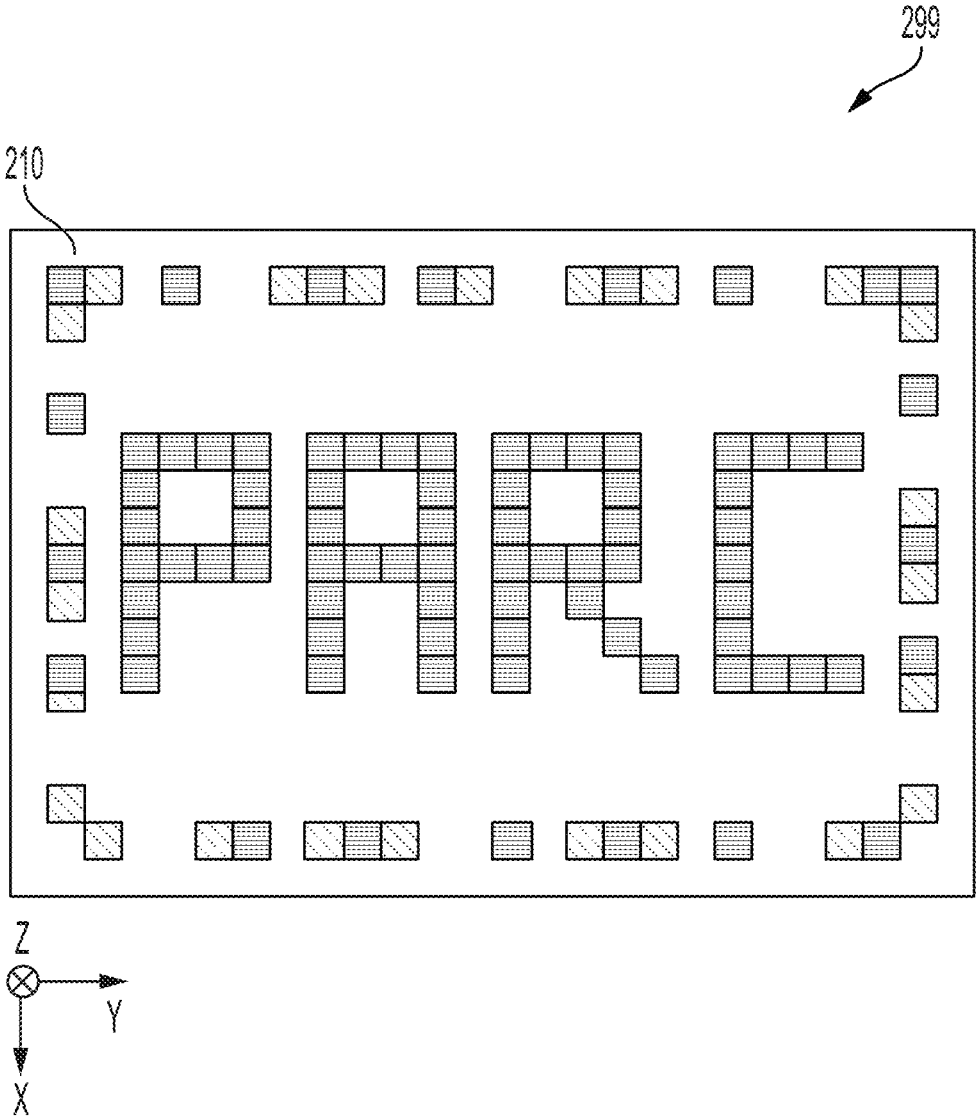
FIG. 3 shows a top view of an article comprising the image formed in the thermochromic layer in or on the substrate in accordance with some embodiments.

FIG. 3 shows a top view of an article comprising the image 299 formed in the thermochromic layer 220 in or on the substrate 210. According to some embodiments, a color of the thermochromic material in layer 220 exhibits a color change of less than $\Delta E_{76}=3$ when exposed to a Level 2 environment as measured by the Blue Wool Scale Fading Card for 35 days.

In some embodiments, the heat source can be configured to produce heating energy that is applied sequentially to each individually selected pixel of the thermochromic layer during the first and/or second heating steps. The heat source may comprise a single heating element and the heat producing energy from the single heating element is scanned across the thermochromic layer to sequentially heat the individually selected pixels pixel-by-pixel. For example, the single heating element may comprise a resistive heating element, a jet configured to expel a stream of hot gas, or a laser source configured to emit laser radiation.

In some embodiments, the heat source can be configured to heat multiple individually selected pixels simultaneously during the first and/or second heating steps. For example, for simultaneous heating, the heat producing energy can be spatially patterned in a single line of multiple pixels or in two or more lines of multiple pixels. For example, the heat producing energy can be patterned in a two dimensional image plane such that multiple individually selected pixels of the thermochromic layer are simultaneously heated to one or more first temperatures during the first heating step and/or to one or more second temperatures during the second heating step.

In some implementations the heat source may comprise multiple heating elements arranged in a two dimensional heating element array that generates a spatial pattern of heat producing energy in a two dimensional image plane. For example, the multiple heating elements may comprise a two dimensional array of resistive heating elements, a two dimensional array of jets configured to expel a stream of hot gas, and/or a two dimensional array of lasers. At any point in time, each heating element of the array can produce a different amount of heat producing energy so as to simultaneously heat individual pixels of the thermochromic material to different first and/or second temperatures according to the image being produced.

In some implementations the heat source may comprise a single heating element in combination with a spatial heat producing energy pattern generator. The single heating element in combination with the spatial heat producing energy pattern generator creates a spatial pattern of heat producing energy in a two dimensional image plane. The combination of the single heating element and the spatial heat producing energy pattern generator can simultaneously heat individual pixels of the thermochromic material to multiple different first and/or second temperatures according to the colors of the image being produced.

In some embodiments, the first and/or second heat sources of an image formation system as described herein may project a two dimensional image plane of heat producing energy to the pixels during activation of the thermochromic material of the pixels (first heating step) and/or during color shifting and color stabilization of the thermochromic material of the pixels (second heating step).

Figure 4A:
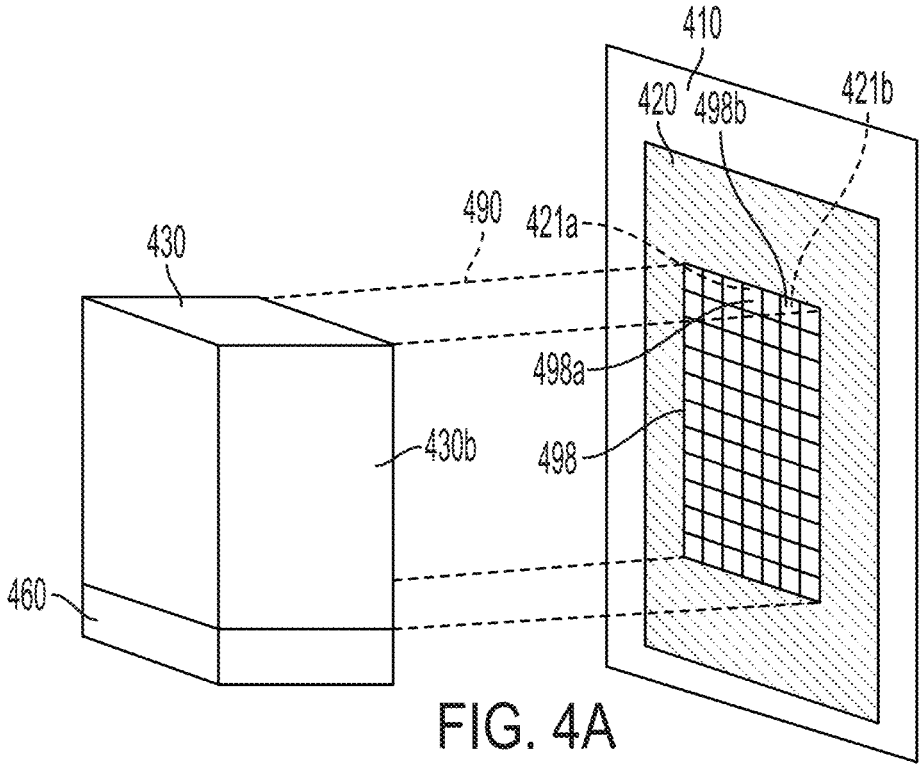
FIG. 4A shows a perspective view of a heat source and a two dimensional image plane of heat producing energy projected onto pixels of thermochromic material disposed on a substrate in accordance with some embodiments.
Figure 4B:
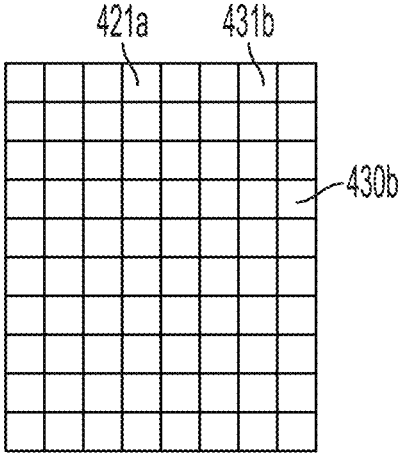
FIG. 4B shows a view of a two dimensional array of heating elements of a heat source which produces a two dimensional image plane of heat producing energy in accordance with some embodiments.

FIG. 4A shows a perspective view of a heat source 430 (which may represent the first and/or second heat sources shown in FIG. 2A) and a two dimensional image plane 498 of heat producing energy 490 projected onto pixels 421*a*, 421*b* of thermochromic material 420 disposed on a substrate 410. FIG. 4B shows a view of a two dimensional array 430*b* of heating elements 431*a*, 431*b* of the heat source 430 which produce the two dimensional image plane 498 of heat producing energy 490. At any point in time, each heating element 431*a*, 432*b* may produce a different amount of heat producing energy (or no heat producing energy) to provide a spatial heating pattern of the two dimensional image plane 498 which includes spatially varying intensity of the heat producing energy.

Figure 4C:
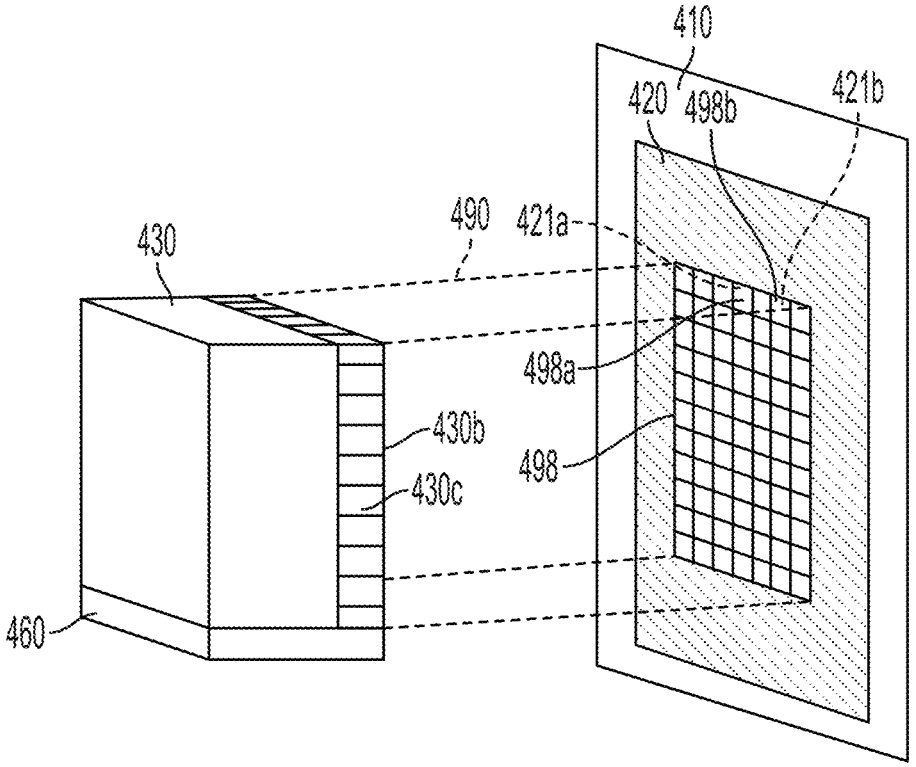
FIG. 4C shows a perspective view of a heat source as in FIG. 4A or 4B that also includes multiple elements disposed between the heat source and the pixels in accordance with some embodiments.
Figure 4D:
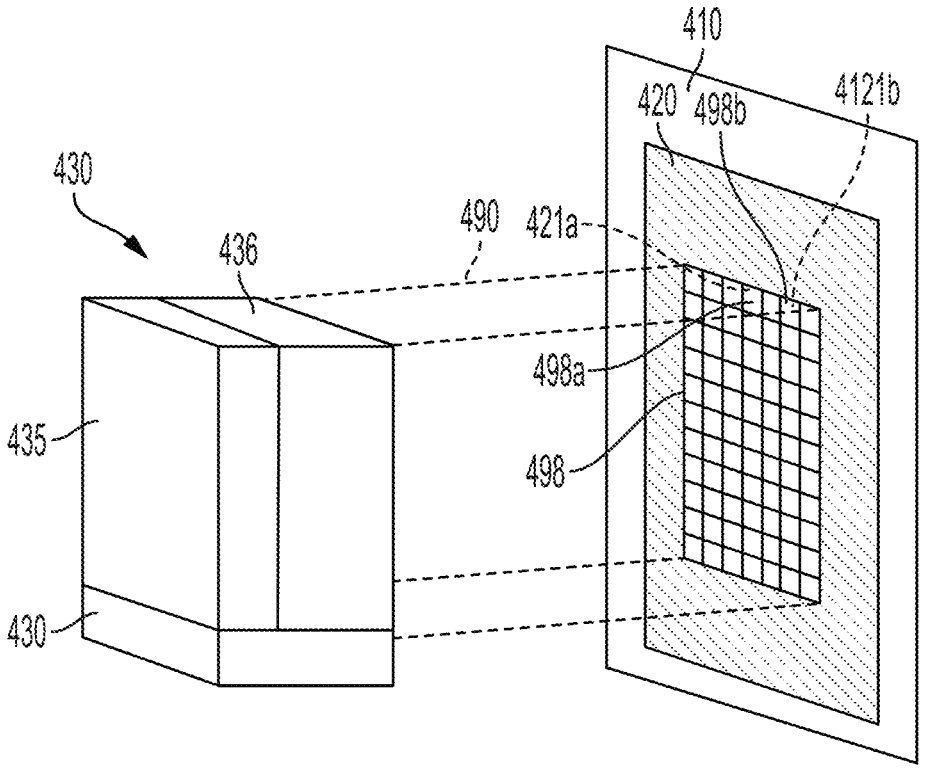
FIG. 4D shows a perspective view of a heat source as in FIG. 4A or 4B that also includes an element disposed between the heat source and the pixels in accordance with some embodiments.

FIG. 4C shows a perspective view of a heat source 430 as in FIGS. 4A and 4B that also includes multiple elements 430*c* disposed between the heat source 430 and the pixels 421*a*, 421*b*. FIG. 4D shows a perspective view of a heat source 430 as in FIGS. 4A and 4B that also includes an element 436 disposed between the heat source 430 and the pixels 421*a*, 421*b*.

Multiple individually selected pixels 421*a*, 421*b* of the thermochromic material 420 that correspond to pixels 498*a*, 498*b* of the two dimensional image plane 498 are simultaneously exposed to the spatially patterned heat producing energy 490 generated by heating elements 431*a*, 431*b*. The spatially patterned heat producing energy 490 may heat all of the multiple individually selected pixels 421*a*, 421*b* to the same temperature, or may heat some of the multiple individually selected pixels 421*a* to a higher temperature and heat some of the multiple individually selected pixels 421*b* to a lower temperature.

The heat producing energy 490 may flow directly from the heating elements 431*a*, 431*b* to the pixels 421*a*, 421*b* in some implementations as indicated in FIG. 4A. In some implementations, illustrated in FIGS. 4C and 4D, there may be one or more elements 430*c*, 436 disposed between the heating elements 431*a*, 431*b* and the pixels 421*a*, 421*b*. The elements 430*c*, 436 may comprise heat producing energy modulators, heat producing energy spatial pattern generators, heat producing energy guiding elements such as heat producing energy reflectors and heat producing energy deflectors, etc. The elements 430*b*, 436 may modulate, pattern, guide, reflect and/or deflect the heat producing energy 490 to produce the two dimensional image plane 498 as further discussed in the examples below.

In some configurations, the movement mechanism component 430*a* may be controlled by the controller 250 (see FIG. 2A) to change the position of the two dimensional image plane 498 of spatially modulated heat energy 490 by translationally moving the entire two dimensional array 430*b* of heating elements 431*a*, 431*b*. During movement of the two dimensional array 430*b* of heating elements 431*a*, 431*b*, the heating elements 431*a*, 4631*b* themselves may be stationary relative to each other within the two dimensional array 430*b* in some embodiments.

In some embodiments, under the control of control circuitry 250 shown in FIG. 2A, the movement mechanism 460 is capable of independently or collectively rotating each heating element 431*a*, 431*b* of the heat source 430 to change the direction of the heat producing energy 490 from the heating element 431*a*, 431*b*. In some scenarios, the heat source 430 is stationary and one or more heating elements 431*a*, 431*b* rotate to address different pixels 421*a*, 421*b* of the thermochromic material 420.

In some embodiments, the movement mechanism 460 comprises one or more elements 430*c*, e.g., deflectors or reflectors arranged relative to the heating elements 431*a*, 431*b* so that the deflectors or reflectors 430*c* are capable of changing the direction of the heat producing energy from the one or more heating elements 431*a*, 431*b*. In one scenario, the heat source 430 is stationary and one or more deflectors or reflectors 430*c*, are rotated collectively or independently to redirect the heat producing energy 490 from the heating elements 431*a*, 431*b* to address different individually selected pixels 421*a*, 421*b* of the thermochromic material 420.

In some embodiments, the heat source 430 may comprise one or more resistive heating elements. Current flowing through the resistive heating elements generates the heat producing energy 490 for heating pixels 421*a*, 421*b* of the thermochromic material 420 to produce an image. For example, a resistive heat source 430 may comprise a two dimensional array 430*b* of resistive heating elements 431*a*, 431*b* capable of forming a two dimensional image plane 498 of spatially patterned heat energy 490. In some embodiments, the heat source 430 may comprise a two dimensional array 430*b* of resistive heating elements 431*a*, 431*b* such that each resistive heating element 431*a*, 431*b* respectively corresponds to a pixel 421*a*, 421*b* of the thermochromic layer 420.

During the first heating step discussed in connection with FIGS. 2A through 2G, the spatially patterned heat energy 490 may provide the individually selected pixels within the image plane 498 with the same amount or heat energy or different amounts of heat energy, so that some of the individually selected pixels 421*a* are heated higher first temperatures associated with a first activation level and others of the selected pixels 421*b* are heated lower first temperatures associated with a second activation level. During the second heating step discussed in connection with FIGS. 2A through 2G, the spatially patterned heat energy 490 may provide the individually selected pixels within the image plane 498 with the same amount or heat energy or different amounts of heat energy, so that some of the individually selected pixels 421*a* are heated higher second temperatures associated with a first color shift and others of the selected pixels 421*b* are heated lower second temperatures associated with a second color shift.

To facilitate heating different pixels to different temperatures, each resistive element 431*a*, 431*b* may be individually controllable. For example, the controller 250 may independently control the current through each of the multiple heating resistive elements 431*a*, 431*b* allowing resistive heating elements 431*a*, 431*b* to provide the same amount of heat to each of the pixels 421*a*, 421*b* or to provide a different amount of heat to different pixels 421*a*, 421*b*.

In some configurations, the movement mechanism component 460 may be controlled by the controller 250 to change the position of the two dimensional image plane 498 of spatially modulated heat energy 490 by translationally moving the entire two dimensional array 430*b* of resistive heating elements. During movement of the two dimensional array 430*b* of resistive heating elements, the resistive heating elements themselves may be stationary relative to each other within the two dimensional array 430*b*.

In some embodiments, the heat source 430 may comprise a source of a heated gas, such as heated air, and one or more gas jets that direct the heated gas toward the pixels of thermochromic material. The heat source 430 may comprise an array 430*b* of multiple gas jets. The gas jets can direct the same amount of heated gas toward each of the individually selected pixels 421*a*, 421*b* of the thermochromic layer 420. Alternatively, the gas jets 431*a*, 431*b* may be independently controllable and capable of directing different amounts of heated gas toward different pixels 421*a*, 421*b* of the thermochromic layer 420. In some embodiments, the heat source 430 may comprise a two dimensional array 430*b* of gas jets 431*a*, 431*b* such that each gas jet 431*a*, 431*b* respectively corresponds to a pixel 421*a*, 421*b* of the thermochromic layer 420.

In some embodiments, under the control of control circuitry 250, the movement mechanism 460 is capable of independently or collectively rotating each gas jet 431*a*, 431*b* of the heat source 430 to change the direction of the heated gas from the jet 431*a*, 431*b*. In some scenarios, the heat source 430 is stationary and one or more gas jets 431*a*, 431*b* rotate to address different pixels 421*a*, 421*b* of the thermochromic material 420.

In some embodiments, the movement mechanism 460 comprises one or more deflectors 430*c* arranged relative to the gas jets 431*a*, 431*b* so that the deflectors 430*c* are capable of being rotated to change the direction of the heated gas streams expelled from the one or more gas jets 431*a*, 431*b*. In one scenario, the heat source 430 is stationary and one or more deflectors 430*c* are rotated collectively or independently to redirect the heated gas from the gas jets 431*a*, 431*b* of the heat source 430 to address different individually selected pixels 421*a*, 421*b* of the thermochromic material 420. A heat source 430 capable of producing a two dimensional spatial heat pattern may comprise multiple gas jets 431*a*, 431*b*, each gas jet 431*a*, 431*b* associated with a deflector 430*c* configured to change the direction of the associated gas jet.

In some embodiments, the heating elements 431*a*, 431*b* of the heat source 430 may comprise one or more lasers that direct heat producing energy 490 (laser radiation) toward the thermochromic material 420. For example, in some embodiments, the laser radiation may be visible, infrared (IR) or near infrared (NIR) radiation that heats the thermochromic material, although other radiation wavelengths may also be useful for heating the thermochromic material.

In some embodiments, the heat source 430 may comprise a two dimensional array 430*b* of lasers 431*a*, 431*b* such that each laser 431*a*, 431*b* respectively corresponds to a pixel 421*a*, 421*b* of the thermochromic layer 420. The two dimensional array 430*b* of lasers 431*a*, 431*b* is capable of generating a two dimensional image plane 498 of spatially patterned laser radiation 490. In some embodiments, one or more guiding elements 430*c*, e.g., waveguides or optical fibers, may be disposed between each laser 431*a*, 431*b* and a corresponding pixel 421*a*, 421*b* of the thermochromic material 420. For example, the lasers 431*a*, 431*b* may be optically coupled to an input end of a corresponding optical fiber 430*c*. The optical fiber 430*c* directs the laser radiation which emerges from the output end of the optical fiber 430*c* toward the thermochromic material 420. In this embodiment, the lasers 431*a*, 431*b* themselves need not be arranged in a two dimensional array because the output ends of the optical fibers 430*c* can be arranged in a two dimensional array providing a spatial radiation pattern that forms a two dimensional image plane 498 of spatially patterned radiation. The controller 250 may comprise circuitry that individually modulates the intensity of each laser 431*a*, 431*b* so as to provide a different intensity of laser radiation to different pixels 421*a*, 421*b*.

The movement mechanism component 460 can be operated to change the direction of the laser radiation. In some embodiments, the movement mechanism component 460 comprises one or more step motors or other mechanism that translationally and/or rotationally moves the entire two dimensional array 430*b* of lasers 431*a*, 431*b* (or other types of heat energy producing elements) and/or moves the entire two dimensional array of associated optical fibers (or other heat energy producing energy directing elements) to direct heat producing energy to individually selected pixels 421*a*, 421*b*.

In some embodiments, the movement mechanism component 460 comprises one or more rotatable mirrors 430*c* disposed between the heat source 430 and the pixels 421*a*, 421*b*. In some scenarios, a single rotatable mirror 430*c* changes the direction of the radiation from heat source 430. In an alternative scenario, the movement mechanism components 460 comprises multiple rotatable mirrors 430*c* and each laser 431*a*, 431*b* is associated with a corresponding rotatable mirror 430*c* that can be independently rotated to redirect the radiation from that associated laser 431*a*, 431*b*.

As illustrated in FIG. 4D according to some embodiments, the heat source 430 comprises a single laser 435 that is optically coupled to a device 436 that spatially patterns the radiation from the single laser 435. The spatially patterned radiation 498 forms a two dimensional image plane 498 of the heat producing radiation 490 that may vary in heat producing energy intensity. For example, the spatial radiation pattern generator 436 may comprise one or more of a liquid crystal spatial radiation modulator such as a liquid crystal on silicon (LCOS), a digital micromirror device (DMD), a grating light valve (GLV), and an acousto-optic modulator (AOM). The spatial radiation pattern generator 436 is configured to spatially pattern the radiation from a single laser 435 or from multiple lasers over a two dimensional image plane 498. In some embodiments, such as when the spatial pattern generator is a GLV, the two dimensional image plane may be one pixel wide.

Under system control, the one or more lasers 435 and the spatial radiation pattern generator 436 can provide pixel-by-pixel control of the intensity of radiation over the two dimensional image plane 498 in accordance with the image being formed. Multiple individually selected pixels 421*a*, 421*b* of the thermochromic material 420 that correspond to pixels 498*a*, 498*b* of the two dimensional image plane 498 are simultaneously exposed to the radiation that varies spatially (along the x and y directions) in radiation intensity. Some of the individually selected pixels 421*a* may be exposed to an amount of radiation that heats the pixels 421*a* to a higher temperature. Some of the individually selected pixels 421*b* may be exposed to a different amount of radiation that heats the pixels 421*b* to a lower temperature. Pixels that are not selected are not heated.

In some embodiments, a movement component 460 is used in conjunction with the one or more lasers 435 and spatial radiation patterning device 436. For example, the movement component 460 may comprise one or more moveable mirrors 430*c* configured to change the direction of the spatially patterned radiation emerging from the spatial radiation patterning device 436.

EXAMPLES

Test samples were prepared using the approaches discussed herein including a second heating step and concurrent second UV radiation step. Comparative samples were prepared that included a second heating step without a concurrent heating second UV radiation step. The test samples were compared to the comparative samples in an accelerated aging test. The test samples were also subjected to environmental testing.

Example 1—Accelerated Aging

In this example, stability of colors formed using a second heating step with concurrent UV radiation step were compared to stability of colors formed using a second heating step without UV radiation. The test sample and comparative sample were identically prepared. The samples comprised a paper coated with thermochromic material comprising diacetylene mixed with near IR absorbers at 0.5% concentration.

A hotplate operated at above 100 degrees C. was used to heat the test and comparative samples to simulate the activation of the pixels. For both samples, the activated thermochromic material was then flood exposed to deep UV light which turns the color of the thermochromic material to blue.

After the first UV flooding, the test sample was exposed to a second heating step at above 160 degrees C. and concurrent UV flood exposure of $\lambda$=254 nm radiation and a dosage of 4000 mJ/cm$^2$ flood to simulate the color shift and color stabilization step. The comparative sample was exposed to a second heating step at above 160 degrees C. without the concurrent UV flood exposure. For each of the test and comparative samples, the second heating shifted the color of the thermochromic material towards red.

Figure 5:
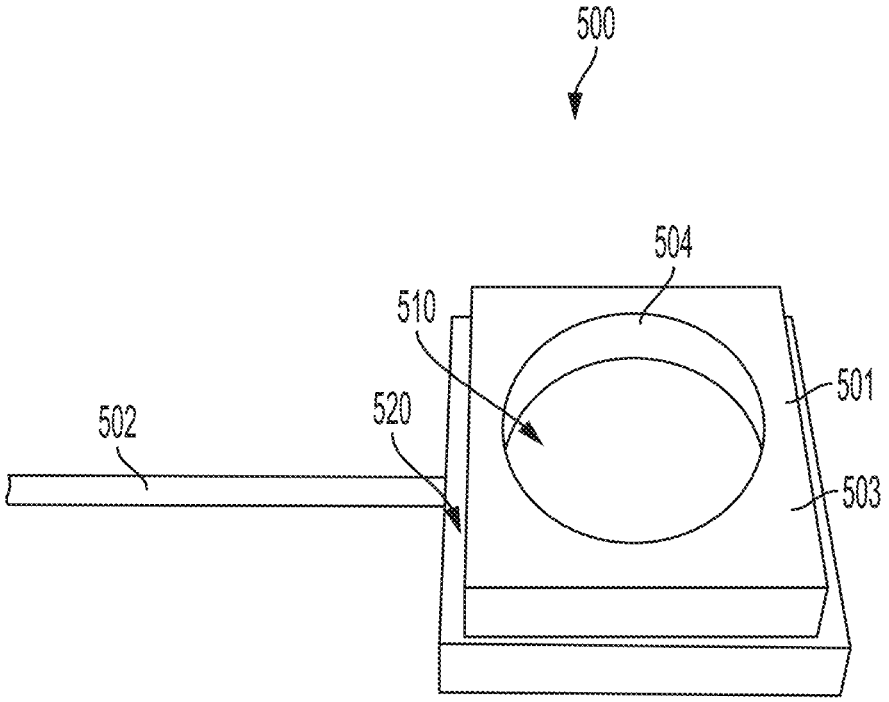
FIG. 5 shows an apparatus used to hold samples during testing.

FIG. 5 shows the apparatus 500 used to hold the paper samples during the testing. The apparatus 500 includes a hotplate 501 with a vacuum system 502 and a stainless steel block 503. The circular opening 504 at the center of the stainless steel block 503 allowed paper in the central area 510 to be exposed to UV radiation during the processing, while the areas 520 along the periphery are masked by the stainless steel block 503 and were not exposed to the UV radiation during the processing.

Figure 6A:
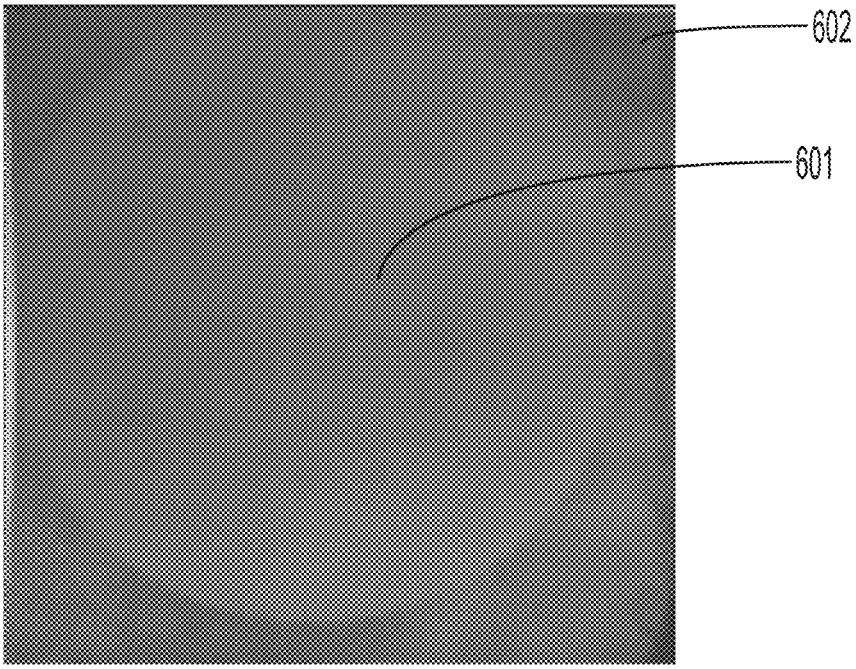
FIG. 6A shows the resulting color of the test sample just after processing.
Figure 7A:
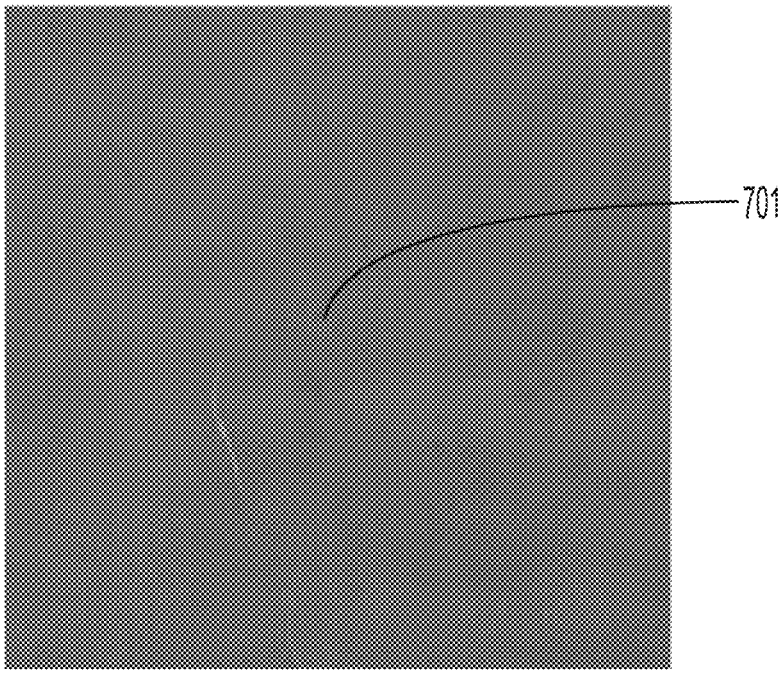
FIG. 7A shows the resulting color of the comparative sample just after processing.

FIG. 6A shows the resulting color of the test sample just after processing. The test sample was exposed to a second heating with concurrent UV exposure as discussed above. FIG. 7A shows the resulting color of the comparative sample just after processing. The comparative sample was exposed to a second heating without concurrent UV exposure.

The center areas 601, 701 of the test and comparative samples achieved a more saturated red than the periphery 602, 702 because the stainless steel block 503 at areas 520 of the periphery (see FIG. 5) touches the sample surface and lowers the temperature during processing.

Figure 6B:
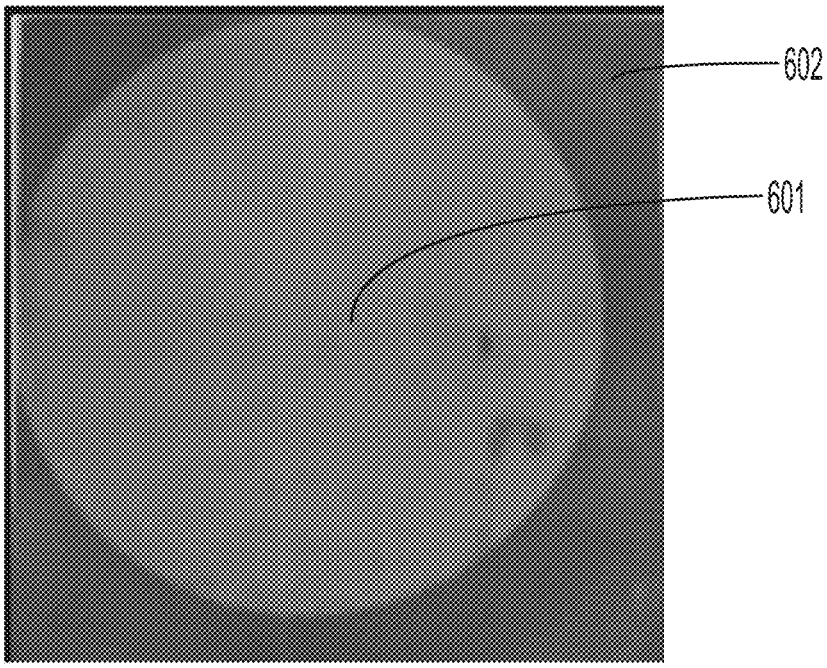
FIG. 6B shows the test sample after accelerated aging.
Figure 7B:
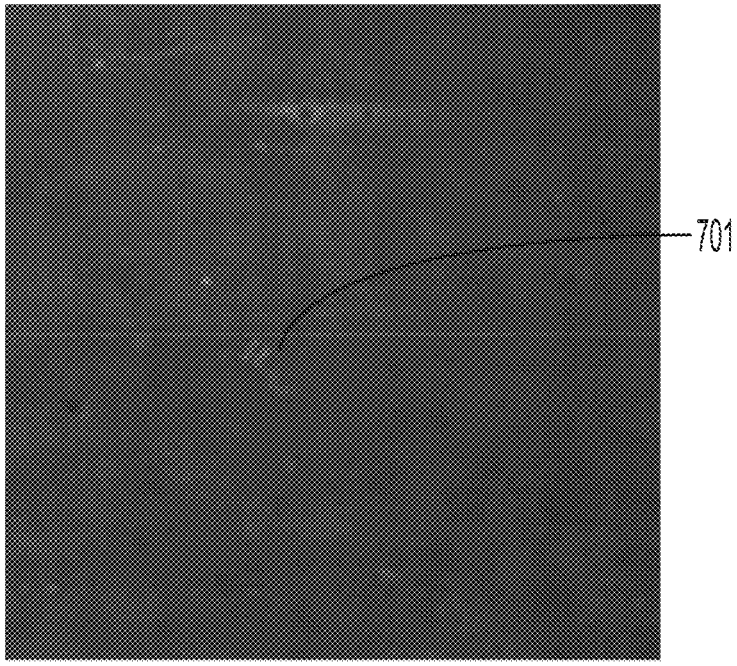
FIG. 7B shows the comparative sample after accelerated aging.

To test for color fastness, the test and comparative samples were subjected to accelerated aging involving UV exposure at $\lambda$=254 nm and 494 mW/cm$^2$ for 1 minute. FIG. 6B shows the test sample after accelerated aging and FIG. 7B shows the comparative sample after accelerated aging. After accelerated aging, the color at the center 601 of the test sample changed minimally with sRGB values after the accelerated aging of 226.4, 58.5, and 60 compared to values of 228, 60, and 60 prior to the accelerated aging. In contrast, the color at the center 701 of the comparative sample was changed dramatically by accelerated aging. sRGB values for the comparative sample at the center 701 after the accelerated aging were 81.4, 60, and 80.2 compared to values of 230, 73, and 90 prior to the accelerated aging.

Example 2—Environmental Testing

In this example a test sample was environmentally tested and the color change of the test sample was calculated using the L*a*b $\Delta E_{76}$ value which is a well-known calculation for quantifying color change. The severity of the environmental exposure was measured according to a Blue Wool Scale Fading Card.

The test sample was prepared as described above including a second heating at above 160 degrees C. with concurrent UV flood exposure of $\lambda$=254 nm radiation and a dosage of 400 mJ/cm$^2$. The test sample was placed inside in a sunny window beside the Blue Wool Scale Fading Card. The color changes of the test sample and the Blue Wool Scale Fading Card were observed after 10 days and after 34 days. After 10 days of environmental testing, the Blue Wool Scale Fading Card exhibited Level 1 fading. After 34 days of environmental testing, the Blue Wool Scale Fading Card exhibited Level 2 fading.

Table 1 provides the L*a*b values for the test sample initially, after 10 days, and after 34 days of exposure to the sun. Table 1 also provides the color difference between the test sample color measurements according to the L*a*b $\Delta E_{76}$ values. The $\Delta E_{76}$ values quantify the color change between the initial color and the color after 10 days of environmental testing ($\Delta E_{76}$=2.73) and the color change between the initial color and the color after 34 days of environmental testing ($\Delta E_{76}$=2.55) indicating that the colors produced by the process that includes a second heating with concurrent UV flooding is extremely stable.

TABLE 1

| Days Aging | L* | a* | b* | $\Delta E_{76}$ |
|---|---|---|---|---|
| 0 | 51.86 | 68.40 | 42.84 | — |
| 10 | 52.23 | 67.55 | 40.27 | 2.73 |
| 34 | 52.23 | 66.57 | 41.10 | 2.55 |
| 70 | 53.34 | 66.85 | 41.32 | 2.63 |
| 95 | 53.76 | 66.84 | 41.60 | 2.75 |

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A method of forming a multi-colored image on a substrate that includes a thermochromic material capable of producing at least two different colors, the method comprising:

heating individually selected pixels of the thermochromic material that correspond to the image to one or more first temperatures sufficient to activate the selected pixels of the thermochromic material for color shift;

flooding an area corresponding to the individually selected pixels with a first UV radiation dosage sufficient to at least partially polymerize the thermochromic material; and heating the individually selected pixels to one or more second temperatures while flooding the area with a second UV radiation dosage.

2. The method of claim 1, wherein:

heating the individually selected pixels to the first temperatures comprises controlling a first heat source to heat the individually selected pixels to the first temperatures;

flooding the area corresponding to the individually selected pixels with the first UV radiation dosage comprises controlling a first UV radiation source to flood the area corresponding to the individually selected pixels with the first UV radiation dosage;

heating the individually selected pixels to the second temperatures comprises controlling a second heat source to heat the individually selected pixels to the second temperatures; and flooding the area corresponding to the individually selected pixels with the second UV radiation dosage comprises controlling a second UV radiation source to flood the area corresponding to the individually selected pixels with the second UV radiation dosage.

3. The method of claim 1, wherein:

heating the individually selected pixels of the thermochromic material to the first temperatures comprises:

heating a first set of the individually selected pixels of the thermochromic material to a higher first temperature in the absence of UV radiation; and heating a second set of the individually selected pixels of the thermochromic material to a lower first temperature in absence of UV radiation; and flooding the area corresponding to the individually selected pixels with the first UV radiation dosage comprises flooding the area without substantially heating the individually selected pixels.

4. The method of claim 1, wherein:

heating the individually selected pixels of the thermochromic material to the second temperatures comprises:

heating a third set of the individually selected pixels of the thermochromic material to a higher second temperature while the area that includes the individually selected pixels is flooded with the second UV radiation dosage; and heating a fourth set of the individually selected pixels of the thermochromic material to a lower second temperature while the area that includes the individually selected pixels is flooded with the second UV radiation dosage.

5. The method of claim 1, wherein the second UV radiation dosage is 1E-6 to 1E+3 times the first UV radiation dosage.

6. The method of claim 1, wherein the second UV radiation dosage is about equal to the first UV radiation dosage.

7. The method of claim 6, wherein the second UV radiation dosage comprises about 400 $mJ/cm^2$ at a wavelength of about 250 nm.

8. The method of claim 1, wherein each of the second temperatures is about 30% higher than any of the first temperatures.

9. The method of claim 1, wherein:

heating the individually selected pixels to the first temperature comprises:

spatially patterning a first heat producing energy; and exposing multiple individually selected pixels of the thermochromic material to the spatially patterned heat producing energy such that a first set of the multiple individually selected pixels are heated to higher first temperature and a second set of the multiple individually selected pixels are heated to lower first temperature, the higher first temperature producing a first color saturation of the thermochromic material and the lower first temperature producing a different second color saturation of the thermochromic material; and heating the individually selected pixels to the second temperatures comprises:

spatially patterning a second heat producing energy in a two dimensional image plane; and simultaneously exposing multiple individually selected pixels of the thermochromic material corresponding to the two dimensional image plane to the spatially patterned heat producing energy such that a third set of the multiple individually selected pixels are heated to higher second temperature and a fourth set of the multiple individually selected pixels are heated to lower second temperature, the higher temperature producing a first color shift of the thermochromic material and the lower temperature producing a different second color shift of the thermochromic material.

10. The method of claim 9, further comprising moving the substrate while heating the individually selected pixels and while flooding the area of the multiple individually selected pixels with the first and second UV radiation dosages.

11. The method of claim 1, wherein:

heating the individually selected pixels to the first temperatures comprises heating the individually selected pixels with laser radiation; and heating the individually selected pixels to the second temperatures comprises heating the individually selected pixels with laser radiation.

12. The method of claim 11, wherein:

heating the individually selected pixels to the first temperatures with laser radiation comprises:

heating a first set of the individually selected pixels to a higher first temperature with a first radiation intensity; and heating a second set of the individually selected pixels to a lower first temperatures with a second radiation intensity; and heating the individually selected pixels to the second temperatures with laser radiation comprises:

heating a third set of the individually selected pixels to a higher second temperature with a third radiation intensity; and heating a fourth set of the individually selected pixels to a lower second temperature with a fourth radiation intensity.

13. An apparatus for forming a multi-colored image on a substrate that includes a thermochromic material capable of producing at least two different colors, the apparatus comprising:

a first heat source configured to provide heat producing energy that heats individually selected pixels of the thermochromic material to one or more first temperatures sufficient to activate the individually selected pixels for color shift;

a first UV source configured to flood an area corresponding to the individually selected pixels with a first UV radiation dosage sufficient to partially polymerize the thermochromic material;

a second heat source configured to provide heat producing energy that heats the individually selected pixels of the thermochromic material to one or more second temperatures after the individually selected pixels have been flooded with the first UV radiation dosage; and a second UV radiation source configured to flood the area corresponding to the individually selected pixels with a second UV radiation dosage during a time that second heat source heats the individually selected pixels to the second temperatures.

14. The system of claim 13, wherein at least one of the first heat source and the second heat source comprises at least one of:

one or more lasers configured to heat the individually selected pixels with laser radiation;

one or more resistive heating elements; and one or more of gas jets configured to expel one or more streams of heated gas.

15. The system of claim 13, wherein one or both of the first heat source and the second heat source comprises:

one or more lasers; and a spatial radiation patterning device, the one or more lasers and the spatial radiation patterning device configured to produce a two dimensional image plane of spatially patterned laser radiation that varies in intensity across the image plane and configured to simultaneously heat multiple individually selected pixels corresponding to the two dimensional image plane.

16. The system of claim 15, wherein one of the two dimensions of the two dimensional image plane is one pixel wide.

17. The system of claim 15, wherein:

the one or more lasers comprises a single laser configured to generate the laser radiation; and the spatial radiation patterning device is configured to spatially pattern the laser radiation from the single laser to produce the two dimensional image plane of spatially modulated laser radiation.

18. The system of claim 15, wherein:

the one or more lasers comprises multiple lasers; and the spatial radiation patterning device comprises a two dimensional array of the multiple lasers, the two dimensional array configured to produce the two dimensional image plane of spatially patterned laser radiation.

19. The system of claim 15, wherein:

the one or more lasers comprises multiple lasers; and the spatial patterning device comprises multiple optical fibers, each optical fiber having an input end respectively optically coupled to one of the multiple lasers and an output end, the output ends of the optical fibers arranged in an two dimensional array configured to produce the two dimensional image plane of spatially patterned laser radiation.

20. The system of claim 13, wherein:

the one or more individually selected pixels comprise multiple individually selected pixels of the thermochromic material;

the first heat source is configured to produce spatially patterned heat energy that simultaneously heats the multiple individually selected pixels to one or more first temperatures;

the first UV radiation source generates UV radiation that floods an area that includes the multiple individually selected pixels;

the second heat source is configured to produce a two dimensional image plane of spatially patterned heat energy that simultaneously heats the multiple individually selected pixels to one or more second temperatures;

the second UV radiation source generates UV radiation that floods an area that includes the multiple individually selected pixels while the multiple individually selected pixels are being heated to the second temperatures; and further comprising a movement mechanism configured to move the two dimensional image plane and the substrate in synchrony.

21. The apparatus of claim 13, wherein the first UV source is configured to flood the area corresponding to the individually selected pixels with the first UV radiation dosage during a time that the individually selected pixels are being heated by the first heat source.

22. The apparatus of claim 13, wherein the first UV source is configured to flood the area corresponding to the individually selected pixels with the first UV radiation dosage after the individually selected pixels have been heated by the first heat source.

* * * * *